US006041752A

United States Patent [19]

Van Klompenburg

[11] Patent Number: 6,041,752

[45] Date of Patent: Mar. 28, 2000

[54] MOLDABLE INTEGRATED OIL PAN AND SUCTION TUBE FOR AN INTERNAL COMBUSTION ENGINE

[75] Inventor: Douglas K. Van Klompenburg, Columbus, Ind.

[73] Assignee: Technology Holdings, Inc., Columbus, Ind.

[21] Appl. No.: 09/185,979

[22] Filed: Nov. 4, 1998

[51] Int. Cl.[7] ..... F16N 31/00; F02M 1/04

[52] U.S. Cl. ..... 123/195 C; 123/196 R; 184/106

[58] Field of Search ..... 123/195 C, 196 R; 184/106

[56] References Cited

U.S. PATENT DOCUMENTS

| | | | |
|---|---|---|---|
| 2,480,486 | 8/1949 | Leazer . | |
| 3,653,464 | 4/1972 | Jacobsen et al. . | |
| 4,056,168 | 11/1977 | Bajohr . | |
| 4,296,716 | 10/1981 | Hofbauer et al. . | |
| 4,378,763 | 4/1983 | Ishihama . | |
| 4,479,463 | 10/1984 | Curley et al. . | |
| 4,615,314 | 10/1986 | Baugh . | |
| 4,630,580 | 12/1986 | Sawaki et al. | 123/196 R |
| 4,909,203 | 3/1990 | Fukuo . | |
| 5,094,201 | 3/1992 | Bedi | 123/196 R |
| 5,133,313 | 7/1992 | Inoue et al. . | |
| 5,136,993 | 8/1992 | Ampferer et al. . | |
| 5,301,642 | 4/1994 | Matsushiro et al | 123/196 AB |
| 5,452,693 | 9/1995 | Clark . | |
| 5,465,692 | 11/1995 | Uraki et al. . | |
| 5,601,060 | 2/1997 | Smietanski et al. | 123/195 C |
| 5,653,205 | 8/1997 | Ozeki | 123/195 C |
| 5,662,080 | 9/1997 | Isono et al. . | |
| 5,791,311 | 8/1998 | Ozeki | 123/196 R |
| 5,894,830 | 4/1999 | Blass et al. | 123/446 |
| 5,937,817 | 8/1999 | Schanz et al. | 123/196 AB |

*Primary Examiner*—Willis R. Wolfe
*Assistant Examiner*—Jason Benton
*Attorney, Agent, or Firm*—Woodard, Emhardt, Naughton Moriarty & McNett, Patent and Trademark Attorneys

[57] ABSTRACT

An oil pan casting for an internal combustion engine having an integrated suction tube formed therein. The suction tube housing is cast as a separate piece, and then affixed to the interior of the oil pan in a clamshell configuration. The interior surface of the oil pan therefore forms a portion of the suction tube enclosure.

21 Claims, 3 Drawing Sheets

MOLDABLE INTEGRATED OIL PAN AND SUCTION TUBE FOR AN INTERNAL COMBUSTION ENGINE

TECHNICAL FIELD OF THE INVENTION

The present invention generally relates to internal combustion engines and, more particularly, to a moldable integrated oil pan and suction tube.

BACKGROUND OF THE INVENTION

Internal combustion engines generally provide an oil pan positioned at the bottom side of the cylinder block and having a comparatively deep relief for receiving accumulated lubricating oil from the engine block, which is pumped throughout the engine under pressure by an oil pump. This oil pump is supplied by an oil inlet suction tube which is immersed in the lubricating oil contained within the oil pan.

Prior art internal combustion engines employ a separate oil inlet suction tube which is assembled with the oil pan at some point during assembly of the internal combustion engine. Such suction tubes may comprise a separate steel tube which is bolted to the engine block and sized to extend down into the oil reservoir within the oil pan or, alternatively, the suction tube may be attached to the interior of the pan.

Although the prior art designs for engine oil pans and suction tubes perform adequately in most situations, there continues to be a need for an oil pan and suction tube design which is lower in cost and may be delivered to the engine manufacturer as a single, integrated unit for bolting onto the engine block. The present invention is directed toward meeting these needs.

SUMMARY OF THE INVENTION

The present invention comprises an oil pan casting for an internal combustion engine having an integrated suction tube formed therein. The suction tube housing is formed as a separate piece, and then affixed to the interior of the oil pan in a clamshell configuration. The interior surface of the oil pan therefore forms a portion of the suction tube enclosure.

In one form of the invention, an integrated oil pan and suction tube for an internal combustion engine is disclosed, comprising: an oil pan having an open top side and an interior surface; and a suction tube housing having a length, said suction tube housing having an open side along at least a portion of said length; wherein said suction tube housing is coupled to said interior surface of said oil pan such that said interior surface closes said open side, thereby forming a suction tube interior passageway between said suction tube housing and said oil pan interior surface.

In another form of the invention, an integrated oil pan and suction tube for an internal combustion engine is disclosed, comprising: an oil pan having an open top side, a closed bottom side, and an interior surface; and a suction tube housing having a proximal end, a distal end, and a length therebetween, said suction tube housing having an open side along at least a portion of said length; wherein said suction tube housing is coupled to said interior surface of said oil pan such that said interior surface closes said open side, thereby forming a suction tube interior passageway between said suction tube housing and said oil pan interior surface; and wherein said proximal end is positioned at said open top side and said distal end is positioned at said closed bottom side.

DETAILED DESCRIPTION OF THE PREFERRED EMBODIMENT

Figure 1:
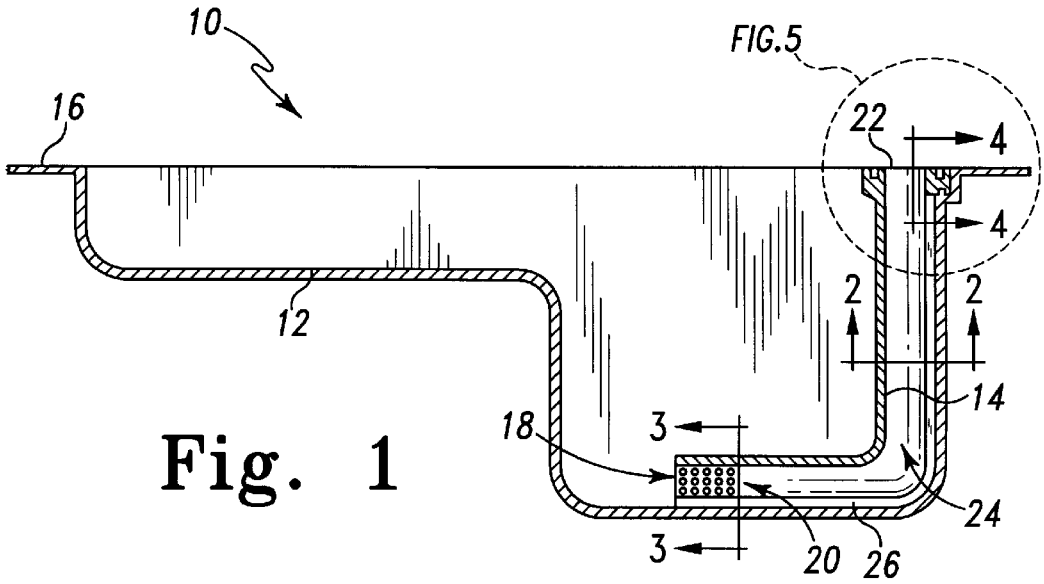
FIG. 1 is a cross-sectional view of a preferred embodiment moldable integrated oil pan and suction tube of the present invention.

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 is a cross-sectional view of a preferred embodiment moldable integrated oil pan and suction tube of the present invention, indicated generally at 10. The assembly 10 includes an oil pan 12 and a suction tube housing 14 coupled to the interior surface thereof. The assembly 10 may then be attached to an engine block 16 by any convenient means, such as bolting. The suction tube housing 14 exhibits a generally L-shaped configuration when viewed in the longitudinal cross-section shown in FIG. 1, such that the distal end 18 thereof is situated at the lowermost portion of the oil pan 12. The suction tube housing 14 contains a plurality of holes 20 formed therethrough near the closed distal end 18 in order to allow oil to enter the interior of the suction tube housing 14. Oil is drawn into the suction tube housing 14 and up into the internal combustion engine by means of an oil pump (not shown) which applies a negative pressure to the proximal end 22 of the suction tube housing 14.

Figure 2:
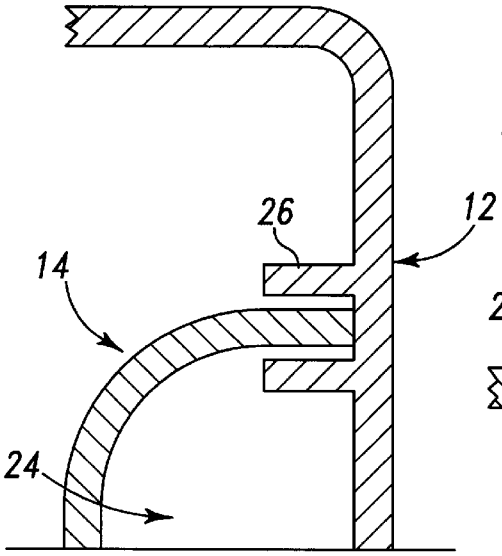
FIG. 2 is a cross-sectional view of the oil pan and suction tube of FIG. 1, taken along section lines B—B.
Figure 3:
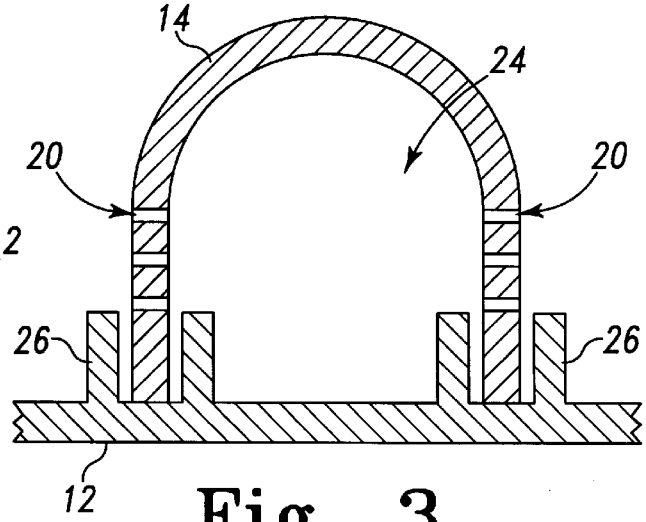
FIG. 3 is a cross-sectional view of the oil pan and suction tube of FIG. 1, taken along section lines C—C.

As best seen with reference to the transverse cross-sections of FIGS. 2 and 3, the suction tube housing 14 does not form a closed tube when separated from the oil pan 12. Instead, the suction tube housing 14 is formed in an open configuration, such as a semi-circle or a three-sided rectangular configuration, although other shapes for the suction tube housing 14 are comprehended by the present invention. The suction tube housing 14 is then attached to an interior surface of the oil pan 12, wherein a portion of the interior surface of the oil pan 12 forms one side of the suction tube interior passageway 24. It is the passageway 24 through which oil flows from the oil pan 12 to the engine block 16.

The suction tube housing 14 may be coupled to the oil pan 12 by any convenient means, such as by adhesive, welding, bolting, etc. In a preferred embodiment of the present invention, the oil pan 12 contains a groove structure 26 formed therein for accepting the open ends of the suction tube housing 14. The interior of the grooves 26 is preferably filled with an oil-resistant silicone sealant in order to maintain the integrity of the suction tube assembly.

Figure 4:
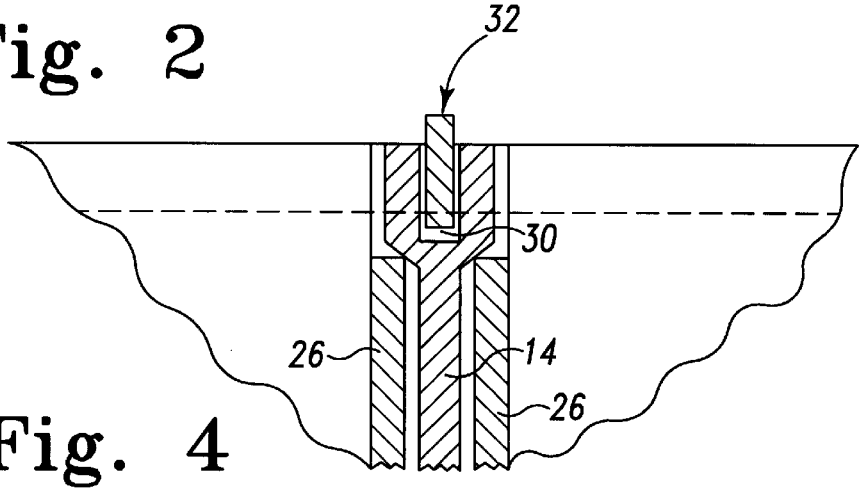
FIG. 4 is a cross-sectional view of the oil pan and suction tube of FIG. 1, taken along section lines D—D.
Figure 5:
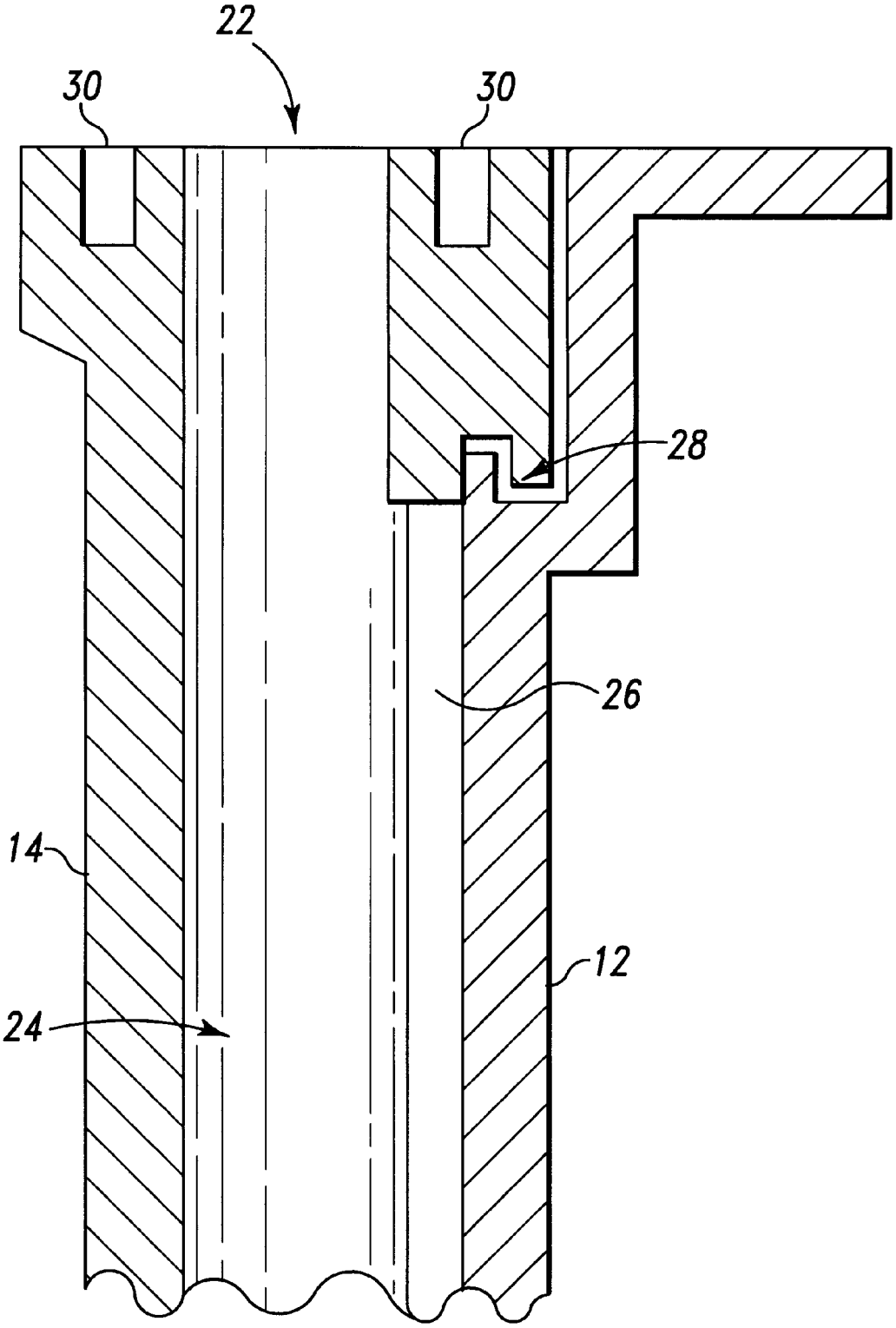
FIG. 5 is a cross-sectional view of a portion of the oil pan and suction tube of FIG. 1.

As best seen in FIGS. 4 and 5, the suction tube housing 14 is preferably formed with a complete circumferential surface at the proximal end 22 thereof. This facilitates mounting of the suction tube housing 14 to the oil pan 12 by means of the interlocking section 28, but more importantly provides a continuous surface for forming a groove 30 for placement of an O-ring seal (such as a square-cut O-ring) to facilitate sealing of the suction tube housing 14 to the engine block. The O-ring 32 (see FIG. 4) contained within the grooves 30 completely surrounds the engine block/oil pan junction, thereby preventing any inadvertent leakage of oil past the boundaries of the suction tube housing 14.

In a preferred embodiment of the present invention, the oil pan 12 and suction tube housing 14 are both die cast from magnesium using a thin-wall die casting technique. For example, the oil pan 12 and suction tube housing 14 may be cast using a THIXOMOLDING technique available from Thixomat, Inc. of Ann Arbor, Mich. The THIXOMOLDING technology is capable of 0.6 mm die castings. Alternatively, the oil pan 12 and suction tube housing 14 could be formed from any other suitable material, such as a different metal or from plastic.

Once the oil pan 12 and suction tube housing 14 have been cast, they can be assembled relatively easily by insertion of the suction tube housing 14 into the grooves 26 and attaching the two pieces by any suitable technique. The assembly 10 may then be delivered to the engine manufacturer as a completed assembly, wherein the assembly 10 may be simply bolted to the engine block for coupling of the oil pan 12 and the suction tube housing 14 thereto with one single operation.

Figure 6:
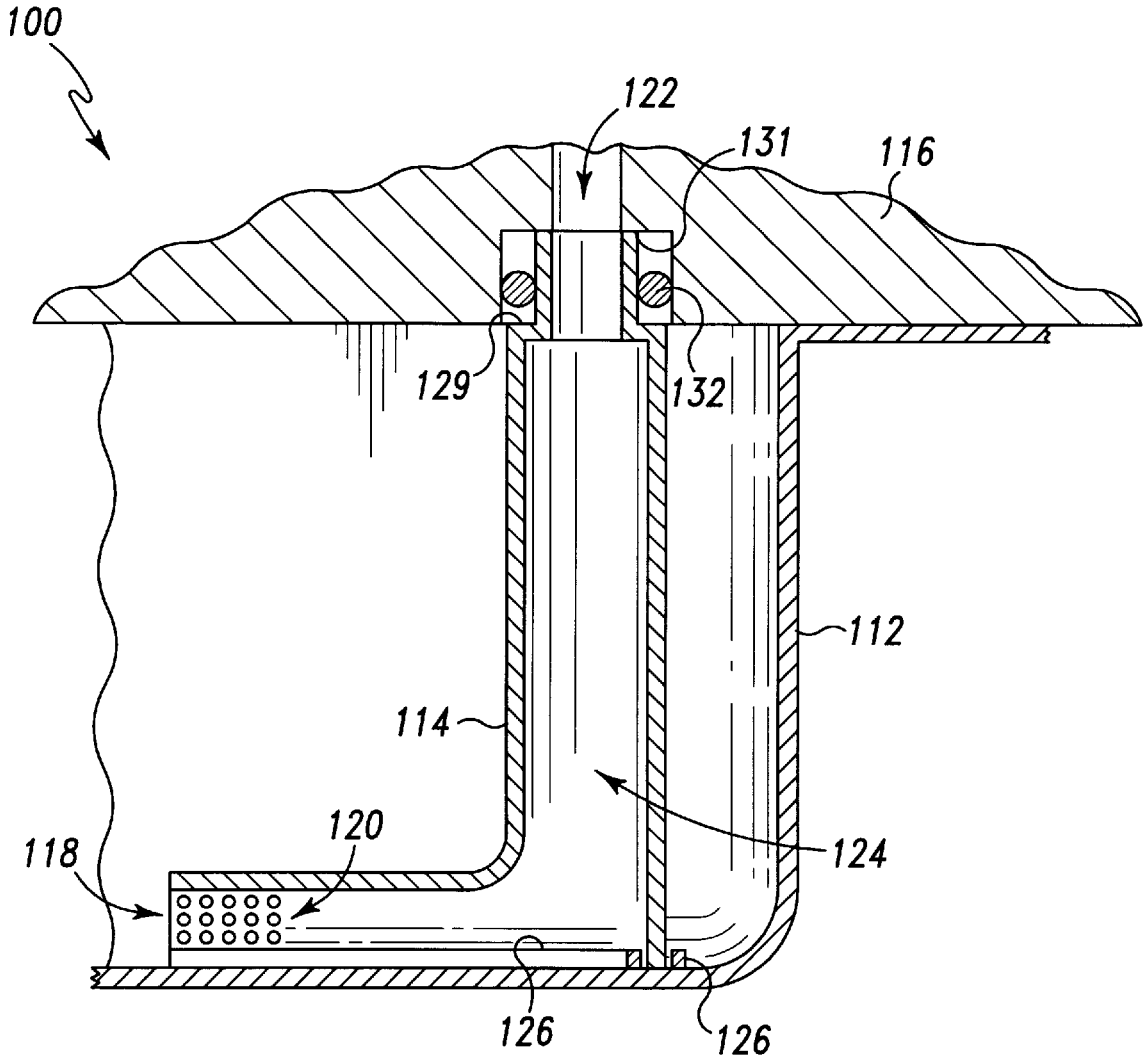
FIG. 6 is a cross-sectional view of an alternate embodiment moldable integrated oil pan and suction tube of the present invention.

An alternative embodiment of the present invention is illustrated in FIG. 6, and indicated generally at 100. The assembly 100 includes an oil pan 112 coupled to the engine block 116. A suction tube housing 114 is coupled to the oil pan 112 by means of the grooves 126 in a manner analogous to that described hereinabove with respect to the housing 14/grooves 26 of the preferred embodiment. However, the suction tube housing 114 is a completely formed tube along its vertical length, while it does not form a closed tube along its horizontal length when separated from the oil pan 112. Therefore, a portion of the interior surface of the oil pan 112 forms one side of the suction tube interior passageway 124 along the horizontal length of the suction tube housing 114.

The suction tube housing 114 includes a plurality of holes 120 formed therethrough near the closed distal end 118 in order to allow oil to enter the interior of the suction tube housing 114. The suction tube housing 114 preferably necks down at its proximal end in order to form an annular shoulder 129. The engine block 116 may then be formed with a counterbore 131 therein, such that a sealing O-ring 132 may be situated therebetween.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An integrated oil pan and suction tube for an internal combustion engine, comprising:

an oil pan having an open top side and an interior surface; and a suction tube housing having a length, said suction tube housing having an open side along at least a portion of said length;

wherein said suction tube housing is coupled to said interior surface of said oil pan such that said interior surface closes said open side, thereby forming a suction tube interior passageway between said suction tube housing and said oil pan interior surface.

2. The integrated oil pan and suction tube of claim 1, wherein said suction tube housing is L-shaped in longitudinal cross-section.

3. The integrated oil pan and suction tube of claim 1, wherein said suction tube is semi-circular in transverse cross-section in a region of said open side.

4. The integrated oil pan and suction tube of claim 1, wherein said suction tube housing has a proximal end located at said oil pan open top side and a distal end located within said oil pan.

5. The integrated oil pan and suction tube of claim 4, further comprising a plurality of holes formed in said suction tube housing near said distal end.

6. The integrated oil pan and suction tube of claim 4, wherein said suction tube housing open side does not extend to said proximal end.

7. The integrated oil pan and suction tube of claim 6, further comprising a circumferential groove formed into said proximal end for receipt of a sealing ring.

8. The integrated oil pan and suction tube of claim 1, further comprising at least one groove formed on said oil pan interior surface such that edges of said suction tube housing open side fit into said at least one groove when said suction tube housing is coupled to said oil pan interior surface.

9. The integrated oil pan and suction tube of claim 8, wherein a joint between said edges and said at least one groove is filled with an oil-resistant sealant.

10. The integrated oil pan and suction tube of claim 1, wherein said oil pan and said suction tube housing are die cast.

11. The integrated oil pan and suction tube of claim 10, wherein said oil pan and suction tube housing are die cast in magnesium.

12. An integrated oil pan and suction tube for an internal combustion engine, comprising:

an oil pan having an open top side, a closed bottom side, and an interior surface; and a suction tube housing having a proximal end, a distal end, and a length therebetween, said suction tube housing having an open side along at least a portion of said length;

wherein said suction tube housing is coupled to said interior surface of said oil pan such that said interior surface closes said open side, thereby forming a suction tube interior passageway between said suction tube housing and said oil pan interior surface; and wherein said proximal end is positioned at said open top side and said distal end is positioned at said closed bottom side.

13. The integrated oil pan and suction tube of claim 12, wherein said suction tube housing is L-shaped in longitudinal cross-section.

14. The integrated oil pan and suction tube of claim 12, wherein said suction tube is semi-circular r in transverse cross-section in a region of said open side.

15. The integrated oil pan and suction tube of claim 12, further comprising a plurality of holes formed in said suction tube housing near said distal end.

16. The integrated oil pan and suction tube of claim 12, wherein said suction tube housing open side does not extend to said proximal end.

17. The integrated oil pan and suction tube of claim 16, further comprising a circumferential groove formed into said proximal end for receipt of a sealing ring.

18. The integrated oil pan and suction tube of claim 12, further comprising at least one groove formed on said oil pan interior surface such that edges of said suction tube housing open side fit into said at least one groove when said suction tube housing is coupled to said oil pan interior surface.

19. The integrated oil pan and suction tube of claim 18, wherein a joint between said edges and said at least one groove is filled with an oil-resistant sealant.

20. The integrated oil pan and suction tube of claim 12, wherein said oil pan and said suction tube housing are die cast.

21. The integrated oil pan and suction tube of claim 20, wherein said oil pan and suction tube housing are die cast in magnesium.

* * * * *